US005198031A

United States Patent [19]

Derstine

[11] Patent Number: 5,198,031

[45] Date of Patent: Mar. 30, 1993

[54] MASK FOR DOOR HINGES

[76] Inventor: Russell L. Derstine, Rte. 1, Box 143-1, Dayton, Va. 22821

[21] Appl. No.: 747,947

[22] Filed: Aug. 21, 1991

[51] Int. Cl.[5] ..... B05C 21/00

[52] U.S. Cl. ..... 118/505; 118/504; 118/301

[58] Field of Search ..... 118/503, 504, 505, 506, 118/213, 301; 16/250, 251, 2

[56] References Cited

U.S. PATENT DOCUMENTS

| | | | |
|---|---|---|---|
| 2,595,785 | 8/1961 | Hallenbeck | 16/250 |
| 3,961,602 | 6/1976 | Dresser | 118/505 |
| 4,195,590 | 4/1980 | Herrington | 118/505 |
| 4,570,291 | 2/1986 | Smith et al. | 16/250 |
| 4,691,409 | 9/1987 | Torgerson et al. | 18/505 |
| 4,796,330 | 1/1989 | Ziegler | 16/251 |
| 4,802,259 | 2/1989 | Geslewitz | 16/251 |
| 4,874,206 | 10/1989 | Sampson | 118/505 |
| 4,921,028 | 5/1990 | Schwartz | 150/155 |
| 5,056,191 | 8/1990 | Love | 118/505 |

FOREIGN PATENT DOCUMENTS

| | | | |
|---|---|---|---|
| 0051568 | 3/1985 | Japan | 118/505 |
| 0100056 | 12/1961 | Netherlands | 110/505 |

*Primary Examiner*—Michael G. Wityshyn
*Assistant Examiner*—Brenda Lamb
*Attorney, Agent, or Firm*—Mason, Fenwick & Lawrence

[57] ABSTRACT

A kit of reusable paint masks for door hinges for use when painting a door and frame comprising two masks, one mask for protecting the door hinge butt plates and the other mask for protecting the pin cylinders. The door hinge butt plate mask is made of a flaccid material having spaced flexible magnetic elements for attachment to magnetically attractable door hinge butt plates by magnetic force. The magnetic elements enable the mask to be readily adjusted for proper registration without requiring removal and reapplication of the mask. A tab is also provided for removal of the mask after completion of the painting. The pin cylinder mask is made of a resilient material of U-shaped transverse cross section with the sides and back engaging the pin cylinder to cover it. Both masks can be manufactured in a variety of standard and specialty sizes.

7 Claims, 1 Drawing Sheet

MASK FOR DOOR HINGES

BACKGROUND OF THE INVENTION

1. Field of the Invention

This invention relates to paint masking devices and particularly to a kit of paint masks for door hinges for use when painting a door and frame.

2. Description of the Prior Art

When painting a door and the adjacent frame it is desirable to avoid placing paint on the door hinge butt plates and the pin cylinder of the hinge. Protecting the butt plates and pin cylinder from paint is difficult due to the position of the hinges and their method of attachment to the door and door frame. In the past, protection against painting the hinge plates has been accomplished through the use of paint shields that are attached to the butt plate with a adhesive material.

One such shield is disclosed by Dresser, U.S. Pat. No. 3,961,602, in which a T-shaped shield consists of a flexible body member having adhesive on the back face for attachment to the butt plate. The T-shaped body member comprises a leg portion for attachment to the butt plate and an arm portion for attachment to the pin cylinders. While this shield adequately protects the butt plate and pin cylinders, it requires that the door be removed from the frame before applying the shield, and reattached to the frame after the paint has been applied, thereby making it time consuming and unacceptably expensive. Also, it utilizes adhesive as a means of attachment, thus limiting the reusability of the shield.

A reusable set of paint covers is disclosed by Herrington, U.S. Pat. No. 4,195,590, which utilizes separate covers for the door frame butt plate and door butt plate. The covers are constructed from a slightly flexible material and can only be installed on the corresponding butt plates by separating the door from the frame. The cover consists of a generally U-shaped element which covers the pin cylinder, a flat panel which is used to cover the butt plate, and a horizontal cap to protect against paint entering the pin cylinder. Thus, while this set of covers is reusable, it requires the removal of the door from the frame during painting, and is expensive due to labor costs.

The use of a mask to protect the butt plates and a separate mask to protect the pin cylinders is disclosed by Ziegler, U.S. Pat. No. 4,796,330. The hinge butt plate cover consists of a flexible panel having adhesive on the back side for engagement with the two butt plates and the pin cylinder part, which is exposed when the door is open, thereby providing protection while the door is in place. The patent also discloses a similar panel having adhesive on the back side which is required to be carefully placed on the pin cylinder in order to fully mask it. Moreover, the reusability of the masks is limited since the mask is stripped away after use so the adhesive is not permanent. Such adhesive is not suitable for multiple reuses, because it loses adhereability after only a few uses. This requires the painter to carry a large supply of these adhesive-attached masks. The movement of the door while painting is limited due to the adhesive contacting the pin cylinders and providing resistance to movement. Further, with an adhesive-attached mask, proper registration with the butt plates is difficult, requiring precise alignment of the mask by the painter. If proper registration is not achieved during the first application, the mask must be removed and reapplied repeatedly until the butt plates are properly covered for painting. This results in delays in time, inconvenience, and added expense.

The use of a single mask to protect the pin cylinders is disclosed by Torgerson et al., U.S. Pat. No. 4,691,409. The mask comprises a body of elastic sheet material and fastening means such as a pair of hooks or a loop. In use, one end of the elastic material is placed over the top of the hinge pin, wrapped around the length of the pin cylinder and attached to the other end of the elastic by a hook or loop. While this cover is reusable, it is difficult to apply and remove because it requires the painter to thread the hook through the space between the door and jamb in order to secure the mask on the pin cylinders. Also, there is no mask for protecting the door hinge butt plates from paint.

A decorative pin cylinder cover is disclosed by Smith et al., U.S. Pat. No. 4,570,291. The cover is constructed of an elastomeric material to move with the hinge, once installed, and takes on a generally U-shaped construction. A pair of caps is also provided for covering the ends of the hinge pin. While this cover provides a means of protecting the pin cylinders and hinge pin, there is no mask for protecting the door hinge butt plates from paint.

The use of a mask to protect hinge pin cylinders during painting is disclosed by Schwartz, U.S. Pat. No. 4,921,028. The mask consists of a flexible panel having adhesive on part of the back side for attachment to the butt plates. Once installed, the pin cylinders and hinge pin are protected from paint. The mask is not suited for multiple reuses, however because the adhesively-attached mask looses its adhereability after only a few uses. Further, if proper registration with the pin cylinders is not achieved the first time, the entire mask must be repeatedly removed and reapplied until the cylinders are covered. Also, the mask protects only the part of the butt plates where the adhesive is applied.

SUMMARY OF THE INVENTION

The present invention comprises a kit of masks comprising a hinge butt plate mask and a pin cylinder mask for protecting, respectively, the butt plate and hinge pin cylinder from paint. The mask is made of a flaccid material having spaced magnetic elements for attachment to magnetically attractive door hinge butt plates, e.g. iron, brass, by magnetic force. The magnetic elements are flexible and spaced on either side of an intermediate central region of the mask. The pin cylinder mask is made of a resilient material of U-shaped transverse cross section with the sides and back engaging the pin cylinder to cover it. Both masks can be manufactured in a variety of standard and specialty sizes.

It is a primary object of this invention to provide a kit of masks for protecting door hinge butt plates and pin cylinders from paint while the door and door frame are being painted which are reusable many times.

Another object of this invention is to provide a paint mask for door hinge butt plates which may be easily relocated on the butt plates, once attached, so that proper registration with the butt plates, and therefore maximum protection against paint, can be achieved.

A further object of this invention is to provide a kit of masks for protecting door hinge butt plates and pin cylinders which will enable one to paint the door and frame without the need for removal of the door from said frame, thus saving time and energy.

Another object of this invention is to provide a kit of masks for protecting door hinge butt plates and pin cylinders which will enable one to paint a door and frame and permit the movement of the door during painting so that paint may be applied over the entire surface to be painted.

Still another object of this invention is to provide low cost masks for providing protection against paint being applied to hinges while painting a door and frame.

A better understanding of the manner in which the preferred embodiment achieves the objects of the invention will be obtained when the following detailed description is considered in conjunction with the appended drawings in which like reference numerals are employed in the different figures for identification of the same component parts of the preferred embodiment.

DESCRIPTION OF THE PREFERRED EMBODIMENT

Figure 1:
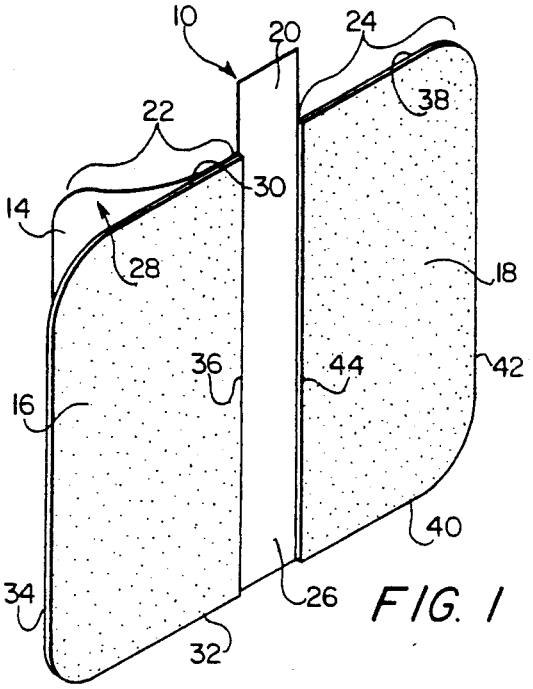
FIG. 1 is a perspective view of the hinge butt plate mask from the back side.
Figure 3:
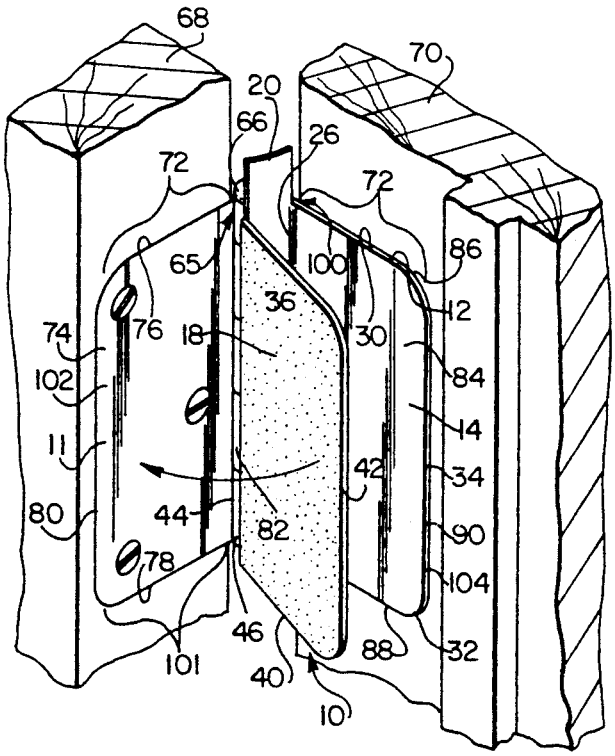
FIG. 3 is a perspective view of the front face of a hinge, door and door jamb with part of the butt plate mask attached to the door frame butt plate.

Referring to FIG. 1 of the drawings, there is shown a paint mask 10 for covering door hinge butt plates. In FIG. 3 there is shown a door 68 and door jamb 70 supported thereon by a hinge 72 comprising a pair of door hinge butt plates 11,12. The mask, as shown in FIG. 1, is comprised of a flaccid sheet 14 to which flexible magnets 16,18 are attached. The magnets 16,18 preferably comprise a body of flexible plastic, rubber-like material having magnetized particles therein.

The mask 10 has a general rectangular configuration, with rounded corners, approximating the size and shape of the door hinge butt plates 11,12, and a tab 20. The mask 10 has three regions comprising two external regions 22,24 on either side of an intermediate region 26. The flexible magnets 16,18 are rectangular in shape and are secured by a permanent bonding agent 28 to the flaccid sheet 14 at the external regions 22,24. External region 22 has a straight top edge 30, bottom edge 32, outer edge 34, and inner border 36. External region 24 has a corresponding straight top edge 38, bottom edge 40, outer edge 42, and inner border 44. Intermediate region 26 has a width which approximately equals the outer diameter of the hinge pin cylinders 46.

Figure 2:
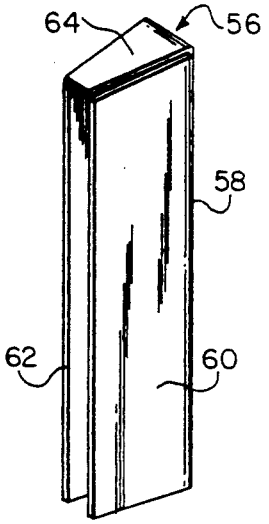
FIG. 2 is a perspective view of the pin cylinder mask from the back side thereof.
Figure 4:
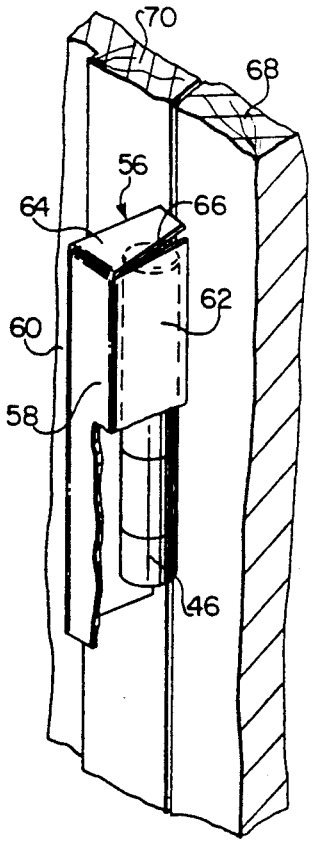
FIG. 4 is a perspective view of the hinge pin cylinder with the pin cylinder mask attached thereto, with parts removed.

Referring now to FIG. 2 of the drawings, there is shown a pin cylinder mask 56 for covering the hinge pin cylinders 46 (FIG. 4). The pin cylinder mask 56 is made of a resilient material such as aluminum and is elongated and of U-shaped transverse cross section. The pin cylinder mask 56 has a back 58, two sides 60,62 each at an acute angle to the back 58, and a top 64. The length of the back 58, as shown in FIG. 4, approximates the length of the hinge pin 66 and the width of the back is approximately equal to the diameter of the hinge pin cylinders 46. The length of each side 60,62 approximates the length of the back 58 and each of the sides 60,62 is slightly wider then the diameter of the hinge pin cylinders 46, to thereby cover the portion 65 of the hinge pin butt plates 11,12 which extend beyond the door 68 and door jamb 70 as shown in FIG. 3. The top 64 of the pin cylinder mask 56 is perpendicular to the back 58 and the length of the top 64 approximates the width of the sides 60,62 and the width of the top 64 equals the width of the back 58.

Referring now to FIG. 3 of the drawings, door hinge butt plate 11 has a face surface 74, top edge 76, bottom edge 78, outer edge 80, and inner edge 82. Door hinge butt plate 12 has a face surface 84, top edge 86, bottom edge 88, outer edge 90, and inner edge 100. Associated with the door hinge butt plates 11,12 are vertically aligned, interdigitated hinge pin cylinders 46. A hinge pin 66 is placed through the aligned hinge pin cylinders 46 to complete the hinge structure 101.

In use, mask 10 is applied to the door hinge butt plates 11,12 such that magnet 18 engages door hinge butt plate 11 and attaches to the butt plate 11 by magnetic force. Also, magnet 16 engages door hinge butt plate 12 and attaches to the butt plate 12 by magnetic force. The magnets 16,18 secure the mask 10 to the butt plates 11,12 but are also flexible to enable the attached mask 10 to readily be adjusted without removal, to enable the painter to readily achieve, precise registration of the mask 10 with the butt plates 11,12.

The mask 10 is properly registered with the butt plates 11,12 to achieve maximum protection against paint on the hinge structure 101 when, straight top edge 38 of external region 24 aligns with top edge 76 of door hinge butt plate 11, bottom edge 40 aligns with bottom edge 78, outer edge 42 aligns with outer edge 80, and inner border 44 aligns with inner edge 82. Straight top edge 30 of external region 22 aligns with top edge 86 of door hinge butt plate 12, bottom edge 32 aligns with bottom edge 88, outer edge 34 aligns with outer edge 90, and inner border 36 aligns with inner edge 100. Intermediate region 26 of the mask 10 is in juxtaposition with the hinge pin cylinders 46 when mask 10 is installed on the door hinge butt plates 11, 12, as best shown in FIG. 3. The mask 10 does not restrict the movement of the door 68, so that the door may be moved to enable paint to be applied to all parts of the door 68 and door jamb 70. A tab 20 is provided on mask 10 for removal of the mask 10 from the door hinge pin butt plates 11,12 after the surrounding surfaces have been painted.

Pin cylinder mask 56 is used by aligning it with the hinge pin cylinders 46 on the rear surface of the door jamb 70 and door 68. Sides 60,62 are placed on the hinge pin cylinders 46, and engage and cover the cylinders 46 along with the back 58. Also, the top 64 of the pin cylinder mask 56 will rest on the hinge pin 66 and provide protection for the hinge pin 66 against paint.

Once the painting is completed, the mask 10 can be easily removed be pulling on the tab 20 and the pin cylinder mask 56 can be easily removed by inserting a finger under the lower portion of the back 58 and lifting upward. The paint mask 10 and pin cylinder mask 56 can be repeatedly reused.

It will be understood that the spirit and scope of the invention is not limited to the preferred embodiment but is to be limited solely by the appended claims.

I claim:

1. For use in painting a door supported from a frame by door hinges which comprise magnetically attractive butt plates and hinge pin cylinders, a reusable mask to provide protection against paint being placed on said butt plates and hinge pin cylinders, said mask comprising a sheet having first and second outer external regions each of size and shape which approximates the size and shape of each of said butt plates, said sheet comprising a flaccid intermediate region between said external regions, said intermediate region being of a size and shape so as to be coextensive with the hinge pin cylinder when applied to said hinge, magnetic means extending only over said outer external regions of said sheet for attaching said sheet only to the hinge butt plates by magnetic attraction forces, and means for securing said magnetic means to said outer external regions of said sheet, said magnetic means and said securing means comprising means for attaching said mask to said hinge without restricting angular movement of the door to which said mask is attached.

2. The reusable paint mask of claim 1, wherein said sheet has a top edge and a centrally located tab which extends beyond the top edge thereof.

3. The reusable paint mask of claim 2 wherein the centrally located tab has a width approximating the width of the cylinder portion of said hinge, whereby said tab may be grasped for removing said mask from said butt plates after the surrounding surfaces have been painted.

4. The reusable paint mask of claim 1 wherein said magnetic means comprising plural magnetic bodies for engagement with said hinge butt plates, said magnetic bodies being flexible and located only in said external regions on either side of said intermediate region, whereby said intermediate region consists of said flaccid sheet defining a flaccid region in juxtaposition with said hinge pin cylinders.

5. The reusable paint mask of claim wherein the magnetic bodies are substantially rectangular in shape.

6. The paint mask of claim 1 and in combination therewith a reusable pin cylinder mask to thereby provide a kit of masks, said pin cylinder mask being of resilient material and being elongated and of U-shaped transverse cross section, said pin cylinder mask having a back, the length of said back approximating the length of said pin cylinder and the width of said back approximating the outer diameter of the hinge pin cylinder, said pin cylinder mask having two sides each formed at an acute angle to the back and converging from said back toward each other to engage and cover the hinge pin cylinder, the length of said sides approximating the length of said back and the width of said sides approximating the outer diameter of said hinge pin cylinder, and a top of said pin cylinder mask substantially perpendicular to said back and whose length corresponds to the width of said sides and whose width corresponds to the width of said back.

7. A reusable pin cylinder mask to provide protection against paint being placed on the hinge pin cylinders, said mask being of resilient material and being elongated and of U-shaped transverse cross section, said pin cylinder mask having a back, the length of said back approximating the length of s id pin cylinder and the width of said back approximating the outer diameter of the hinged pin cylinder, said pin cylinder mask having two sides each formed at an acute angle to the back and converging from said back toward each other to engage and cover the hinge pin cylinder, the length of said sides approximating the length of said back and the width of said sides approximating the outer diameter of said hinge pin cylinder, and a top of said pin cylinder mask substantially perpendicular to said back and whose length corresponds to the width of said sides and whose width corresponds to the width of said back.

* * * * *